United States Patent [19]

Walter

[11] Patent Number: 4,582,148

[45] Date of Patent: Apr. 15, 1986

[54] MECHANO-HYDRAULIC DOUBLE-ACTING DRILLING JAR

[75] Inventor: Bruno H. Walter, Edmonton, Canada

[73] Assignees: B. Walter Research Company, Ltd, Edmonton; Titan Tools, Inc., Leduc, both of Canada

[21] Appl. No.: 558,104

[22] Filed: Dec. 5, 1983

[51] Int. Cl.[4] ..... E21B 4/14

[52] U.S. Cl. ..... 175/297; 175/300; 175/304

[58] Field of Search ..... 175/297, 296, 300, 304; 166/178

[56] References Cited

U.S. PATENT DOCUMENTS

| | | | |
|---|---|---|---|
| 2,710,171 | 6/1955 | Bagnell | 175/297 |
| 3,955,634 | 5/1976 | Slator et al. | 175/297 |
| 4,109,736 | 8/1978 | Webb et al. | 175/304 |
| 4,161,224 | 7/1979 | Hostrup | 175/297 |
| 4,456,081 | 6/1984 | Newman | 175/297 |

FOREIGN PATENT DOCUMENTS

| | | | |
|---|---|---|---|
| 1005810 | 2/1977 | Canada | 175/297 |

*Primary Examiner*—Stephen J. Novosad
*Assistant Examiner*—Bruce M. Kisliuk
*Attorney, Agent, or Firm*—Edwin J. Spangler, Jr.

[57] ABSTRACT

This invention relates to a double-acting drilling jar characterized by a constantly recharged hydraulic system operating in concert with a mechanical brake to actuate the latter and temporarily inhibit extension of the relatively moving parts utilizing a modest fluid pressure multiplied many-fold so as to exert a holding force far in excess of that which the hydraulic system could impose alone without destroying the seals. The invention also encompasses the virtual elimination of heat build-up through the use of drilling mud as the working fluid in a hydraulic system where once-used fluid is discharged downhole before it gets too hot while, at the same time, being replaced by a fresh supply of cool fluid from the surface. By calling upon the hydraulic system to only exert enough force to actuate the mechanical system, none of the fluid seals need be loaded to anywhere near their capacity.

14 Claims, 10 Drawing Figures

MECHANO-HYDRAULIC DOUBLE-ACTING DRILLING JAR

Both mechanical and hydraulic drilling jars are commonplace in the oil industry and they are used to free stuck bits and other downhole apparatus. Not all formations present this problem but, where it exists, some type of drilling jar in the drill string provides the opportunity to free a stuck element without having to undertake an expensive and time-consuming fishing operation.

Both types of jars used splined male and female elements which are capable of transmitting torque to the bit as well as telescoping relative to one another so as to impart the type of impact blow required to bump or jar the bit loose. Some such tools only bump down, others jar up and still others do both. Modern drilling jars are more likely to be hydraulic than mechanical because the latter lack the capability of varying the magnitude of the impact. Hydraulic jars, too, have their shortcomings and these involve primarily two areas, specifically, seal failure and heat build-up. Both of these deficiencies are, in turn, associated to a greater or less degree with the use of a fixed supply of oil as a hydraulic medium.

The prior art hydraulic drilling jars that jar upwardly (most do both) are exemplified by U.S. Pat. Nos. 2,551,868; 2,710,171; 2,922,626; 2,981,336; 3,804,185; 3,955,634; and 4,109,736. Fundamentally, they all work the same way in applying an upwardly-directed jarring blow. As the drill string is stretched and placed under tension, a piston carried by one of the telescoping members moves in sealed engagement with the other telescoping member at a controlled rate determined by how much hydraulic fluid is allowed to leak past the seal generally either through ports in the piston or bypasses therearound. The fluid that is not bypassed is trapped in a suitable chamber where its pressure builds to a level controlled by the "quickness" of the pull. As the volume of this chamber steadily decreases due to the controlled escape of fluid therefrom, suddenly the piston reaches an enlargement in the bore through which the trapped fluid instantly escapes and allows the telescoped parts to "bang" together imparting an impact blow tending to break the stuck bit loose as the stretched drill string contracts.

The source of most problems associated with hydraulic jars embodying the aforementioned prior construction is the hydraulic fluid itself. To begin with, the supply of fluid used is finite and must be sealed off from the drilling mud which continually circulates down through the bore of the drill string, out through the bit and back up to the surface along the outside to carry away the cuttings. Not only must seals be used to separate these incompatible fluids from one another but, in addition, the jar must be made much longer to accommodate the additional compartmentalization required. As is the case with most downhole tools, the shorter the better, since directional stability is more easily attained.

The seals constitute an even greater problem than excessive length since such seals are rarely effective at pressures past about 5000 p.s.i., yet, it is not uncommon in a jar to find them subjected to pressures well in excess of three times this high. The result is, of course, premature failure. Couple this with the fact that after only a couple of actuations of the prior art hydraulic jars, the encapsulated hydraulic fluid boils and places these seals under even greater stress because when the viscosity of the fluid goes down it becomes much more difficult to contain. The only solution, therefore, is to let the jar rest between blows until the fluid cools down. The resultant delay, however, has a serious effect upon the one and only function of the tool, namely, that of freeing the stuck bit. For example, it is not uncommon to find that a period of five minutes or longer must elapse between blows. Moreover, once the fluid becomes less viscous, it moves through the bypass porting more quickly thus throwing off the timing of the blow and the predictability of its magnitude which is one of the main advantages a hydraulic jar supposedly has over a mechanical one. The significance of this is that the formation gripping the bit is somewhat resilient and, as a blow is delivered thereto, it momentarily reacts and shifts to a degree which, hopefully, will release the stuck part. If, however, a time interval must elapse before a second blow is delivered that allows the formation to return to its original condition, the tool remains stuck and nothing of significance has been accomplished.

It has now been found in accordance with the teaching of the instant invention that these and other shortcomings of the prior art hydraulic jars can be overcome by the novel expedient of, first of all, using the drilling mud as the hydraulic working medium. By so doing, the tool can be made much shorter than the prior art tools since no chamber containing a floating piston need be provided for separating the mud from the oil. The problems ordinarily associated with heat build-up become negligible because that mud which starts to get hot during a particular actuation is quickly discharged downhole and replaced by a fresh cool supply. With only modest temperature rises occasioned by modest operating pressures, viscosity changes are minimal and well within the ability of ordinary shaft seals to contain. Most important, however, is the ability of the system to deliver twenty to fifty times the energy to the formation over the same time interval as other hydraulic jars heretofore known.

The other main feature of the present mechano-hydraulic jar is that of using the hydraulic system as a servomotor operative to actuate a mechanical brake effective to inhibit extension of the tool to deliver the jarring blow with a force many times greater than that which the hydraulic system alone is capable of sustaining without significant seal damage, yet at a very modest operating pressure of only a few hundred p.s.i. By so doing, the pressures to which the seals confining the trapped drilling mud are subjected can be a small fraction of their capacity. Since the pressures generated by the drilling mud needed to actuate the brake are comparatively quite low, the heat build-up in the fluid is negligible and repeated rapid actuations become possible thus permitting a good deal more energy to be transferred to the formation in a given interval than has heretofore been possible.

In the prior art jars, the hydraulic fluid slowly bleeding from the chamber between the telescoped elements transfers the entire load of the tensioned drill string to the seals, whereas, in the present unit the only loads the seals see is the modest one required to actuate the mechanical brake and keep it in sliding frictional contact with the extending knocker tube until the release point is reached where the piston moves into the enlargement in the housing therefor. In fact, a pressure relief valve set to open at a pressure far below that at which damage to the seals takes place is provided in the preferred embodiment.

The brake mechanism itself is unique in that the fluid (mud) pressure in the chamber whose volume is decreasing as the telescoped elements move apart is used to collapse an elastic boot radially inward thereby squeezing the segments of a segmented metal ring or sleeve against the knocker tube moving therein. Proper selection of materials for the segmented ring with high coefficients of friction enhance the braking action.

It is, therefore, the principal object of the present invention to provide a novel and improved drilling jar of the mechano-hydraulic type.

A second objective is the provision of a device of the character described wherein drilling mud already present in the system is used as the working fluid for the hydraulic system.

Another object of the within described invention is to provide a hydraulically-actuated mechanical brake for multiplying the frictional force inhibiting extension of the telescoped elements by a factor many times greater than that which could be generated by the hydraulic system alone without damaging or destroying the seals.

Still another objective is to provide a mechano-hydraulic system for a drilling jar wherein the loads in the tensioned drill string are borne by the mechanical elements and the loads imposed by the hydraulic component on the seals is limited to that required to actuate the latter.

An additional object of the invention is to provide a drilling jar wherein heat build-up and the many problems assodiated therewith are virtually eliminated with the result that a stiffer, shorter, faster-acting tool results.

Further objects are to provide a combination mechanical and hydraulic double-acting drilling jar that is reliable, compact, rugged, safe, easy to service, versatile, responsive, capable of long term sustained use, and one that can be counted upon to deliver more energy per unit of time than any other hydraulic jar heretofore known.

Other objects will be in part apparent and in part pointed out specifically hereinafter in connection with the description of the drawings that follows, and in which:

FIG. 1–3, inclusive, constitute side elevations, half in diametrical section, showing successive segments of the tool in fully-retracted condition, portions of each segment having been broken away to conserve space;

FIGS. 3–6, inclusive, are analogous to FIGS. 1–3 except that they show the tool in fully-extended condition;

Figure 6:
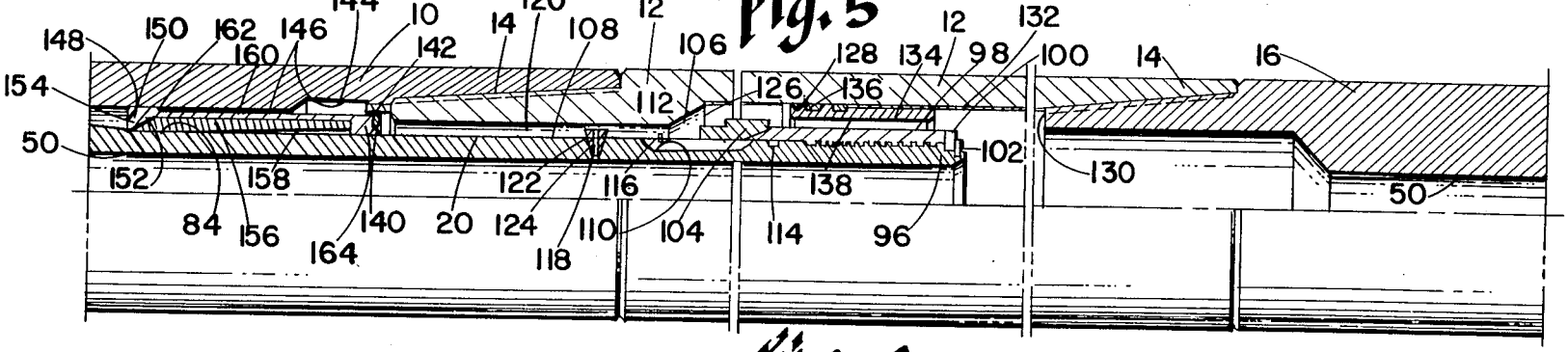
Figure 7:
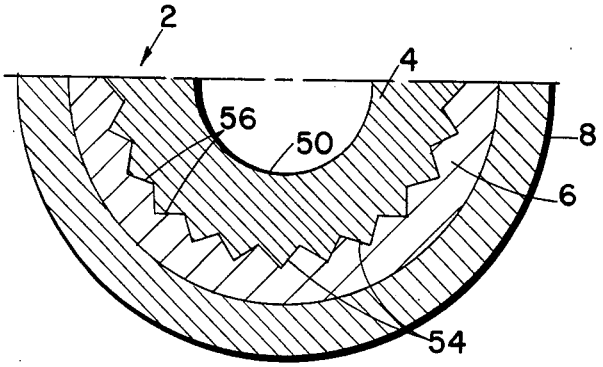
FIG. 7 is a diametrical half section taken along line 7—7 of FIG. 2.

Referring next to the drawings for a detailed description of the present invention, reference numeral 2 has been chosen to designate the hydraulic jar generally while numerals 4 and 6 connote the externally-splined male mandrel and the internally-splined female element, respectively, that telescope axially one inside the other but are prevented from relative rotation by the splined connection therebetween, the latter having been shown most clearly in the diametrical section FIG. 7. Female element 6 comprises the uppermost section of a four section tubular housing or barrel, the other sections of which have been identified by reference numerals 8, 10 and 12 as shown in FIGS. 1–6, inclusive. The several sections aforementioned are threadedly interconnected as indicated at 14 in coaxial relation. Section 12 terminates in an internally-threaded socket that screws onto a section of drill pipe 16 therebeneath or the bit itself using the conventional threaded coupling 14. A female internally-threaded socket 18 is provided at the upper end of the male mandrel 4 for suspending the whole jar 2 from the drill string.

For lack of a more appropriate term, the tubular extension of the male spline will be referred to as a "knocker tube" and designated by reference numeral 20. This element is shown most clearly in FIGS. 2, 3, 5, 6 and 8–10, inclusive. The connection between the aforementioned knocker tube and the mandrel 4 comprises essentially the same type of threaded connection 14M used between the sections of the barrel but of a different size.

Figures 1, 2, 3:
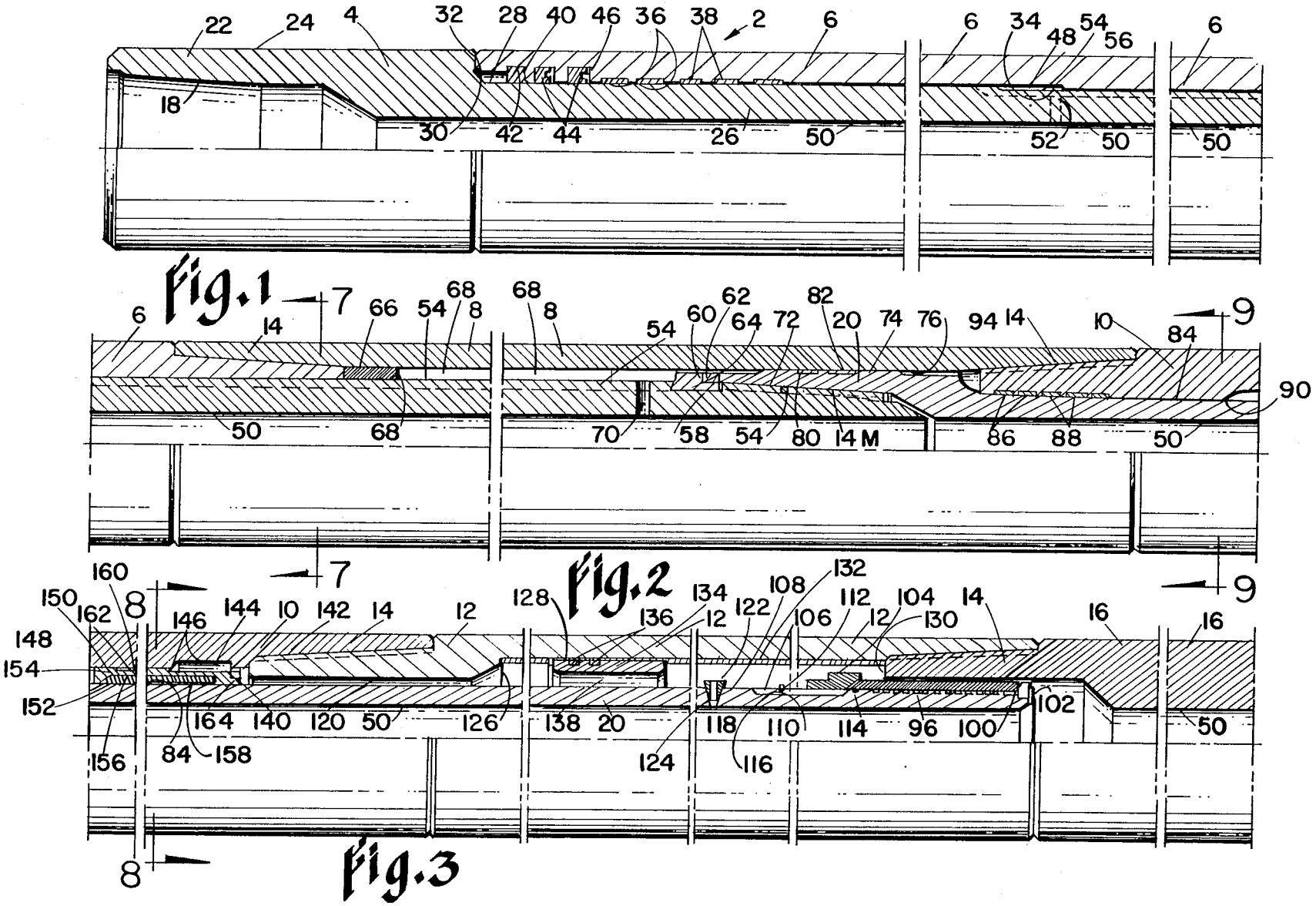
Figure 4:
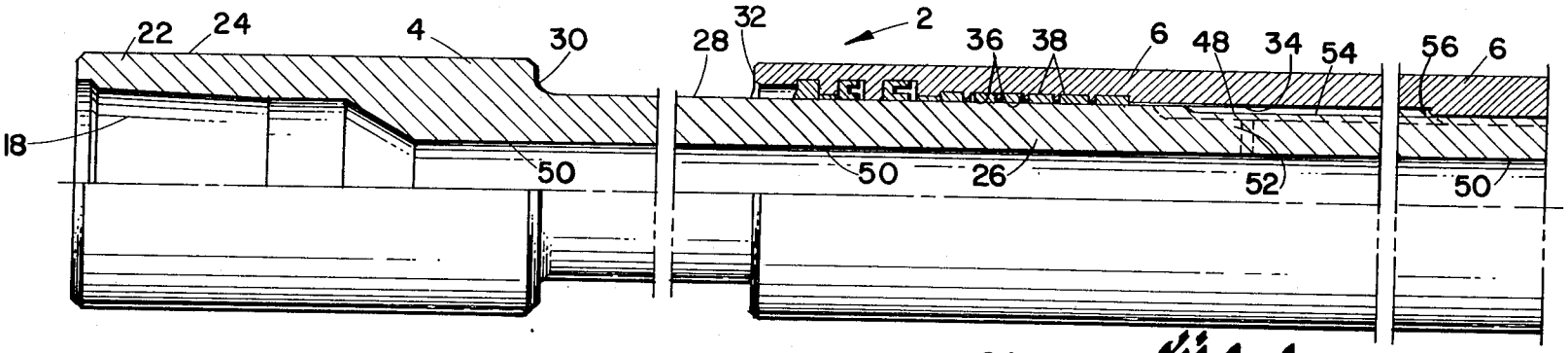

With reference to FIGS. 1 and 4, the mandrel 4 can be seen to have an integrally-formed collar 22 at its upper end which contains the internally-threaded socket 18 and has an outer cylindrical surface 24 having the same diameter as that of female splined element 6, the two cooperating to produce a smooth-surfaced housing for rotation within the bore. Adjacent collar 24, the mandrel is necked-down to produce reduced diameter neck 26 which is, likewise, cylindrical, ground smooth and chromed to provide a hard polished wearing surface 28. Separating collar 22 from the neck 26 of the mandrel 4 is an annular shoulder 30 against which the upper end 32 of the female splined element strikes when the tool "bumps" down in the manner to be explained in greater detail presently. These opposed abutting surfaces 30 and 32 are also ground smooth and hardened to resist the wear occasioned by their impacting against one another.

Thinner cylindrical surface 34 of the female element 6 that lies in opposed relation to hardened surface 28 of the mandrel neck 26 is spaced apart therefrom slightly, provided with a longitudinally-spaced series of annular grooves 36 and fitted with a plurality of wear rings 38 that constitute the elements in actual sliding contact with the mandrel. Dirt and debris, cuttings, material sluffing off the bore wall and the like are wiped clean off the part of hardened mandrel neck surface 28 exposed thereto by a wiper ring 40 housed in an annular groove 42 at the top of the female splined element 6. Between the aforementioned wiper ring 40 and the uppermost wear ring 38 of the series is an annular pressure-actuated fluid seal 44 housed in its annular groove 46. Clean drilling mud fills the small cavity 48 between the opposed surfaces 28 and 34 of the mandrel neck and female spline thus wetting same and lubricating the wear rings. The wiper ring 42, of course, keeps the dirty mud and other contaminants from entering the cavity while sealing ring 44 keeps the clean mud from escaping into the bore.

Mandrel 4 is, of course, hollow having an axial bore 50 therethrough for the passage of clean drilling mud downhole to the bit where it washes away the cuttings and carries them back to the surface. Clean mud enters a cavity 48 through bleed hole 52 located in the neck 26 just above the splines 54 on the mandrel. The hydrostatic pressure of the column of mud thereabove keeps cavity 48 supplied with mud. When the splined connection between elements 4 and 6 moves from the open or extended position of FIG. 4 into the closed or retracted position of FIG. 1, mud trapped in cavity 48 leaves by way of bleed hole 52 also and thus does not impede the retraction stroke of the tool where the female splined part 6 is essentially stationary and male element 4 is bumping down thereagainst.

FIGS. 1, 2, 4, 5 and 7 reveal the splined connection between male and female splined elements 4 and 6, respectively. Generally V-shaped splines 54 on the male element slide within the mating grooves formed between adjacent splines 56 of the female element. The resulting connection, of course, allows for relative longitudinal or axial movement between the telescoped elements while, at the same time, providing for the transfer of torque from the male member 4 to the female member 6 and from the latter to the bit (not shown).

In FIGS. 2 and 4, it will be seen that the mandrel splines 54 are interrupted near their lower end by an annular groove 58 into which the two halves of a stepped ring 60 fit. An endless lock ring 62 slips onto the reduced diameter section 64 in the stepped ring holding the halves thereof in assembled relation within groove 58. The split ring 60 defines the stop or abutment engaged by the hardened steel anvil 66 located in the annular cavity 68 beneath lower ends of splines 56 of the female splined element 6 when the tool extends to "jar up" as opposed to bumping down.

Now, in order to assemble the elements of the tool described above, the mandrel 4 must first be passed into and through the female element 6 until groove 58 in the latter emerges and becomes accessible beyond the splines 56, whereupon, the bumper ring 66 is passed over the splined end of element 4 into abutting relation against the ends of splines 56 of the female element and next the subassembly consisting of stepped ring 60 and lock ring 62 are assembled in place. This, obviously, connects the splined elements 4 and 6 together for limited telescopic movement between the fully-retracted position of FIGS. 1–3 and the fully-extended one of FIGS. 4–6.

Cavity 68 below the female splined part, like cavity 48 thereabove, is connected through to the central bore 50 by a bleed hole 70. Clean mud under a certain head depending upon the depth of the tool moves into and out of cavity 68 as the volume thereof changes due to the excursions of the male and female elements 4 and 6 between their retracted and extended positions. As before, the clean mud serves as the lubricant keeping the splined section lubricated without inhibiting the relative telescopic movement therebetween. Also, any raise in temperature of the mud occasioned by its forceful ejection back into the bore when the tool retracts is of no consequence since the mud thus heated is discharged downhole and a fresh, clean cool supply replaces it.

When threadedly connected to the mandrel as shown at 14, the upper end 72 of the knocker tube butts up against the lock ring 62. The outer cylindrical surface 74 on the upper end of the knocker tube lies in spaced relation to the opposed surface 76 on the inside of the barrel 8. Bridging the gap 78 therebetween are wear rings 80 housed within annular groove 82 in surface 74. Surface 76 of the barrel is chromed and polished to reduce wear as the knocker tube slides axially therealong with the mandrel to which it is threadedly attached.

The medial cylindrical portion 84 of the knocker tube is necked down to fit loosely inside barrel section 10 where it slidingly engages a series of wear rings 86 seated within annular grooves 88 in inner cylindrical surface 90. Medial portion 88 is polished and chromed as are all the wearing surfaces in sliding contact with the wear rings. Clean mud, once again, enters bleed hole 92 and moves up into gap 78 to wear ring 80 as well as down into the space between medial portion 84 and surface 90 where it keeps wear rings 86 lubricated.

Figure 5:
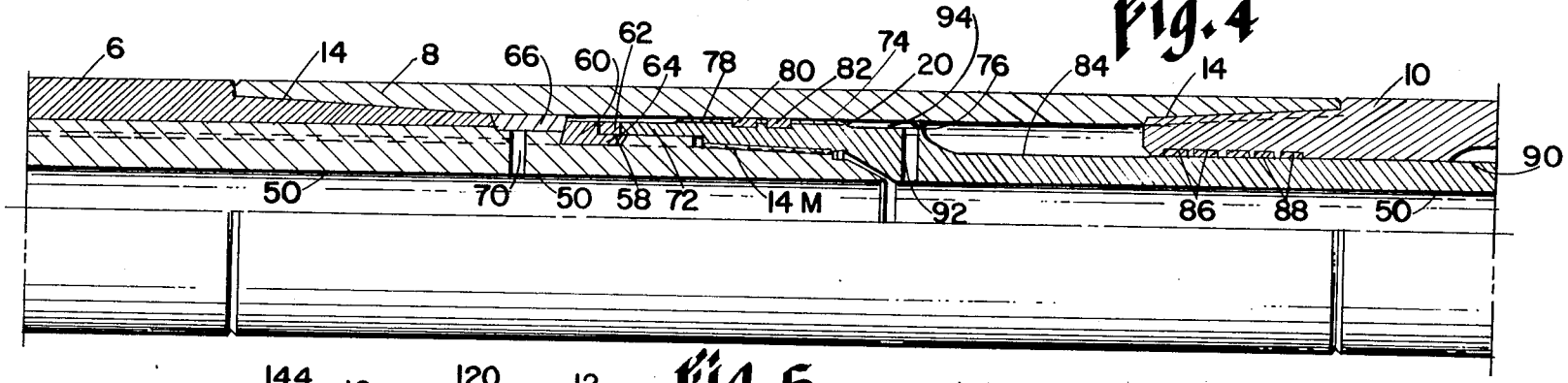

Referring briefly to FIGS. 2 and 5, it can be seen that the upper end of the knocker tube 20 carries a flattened surface 94, there being a parallel surface on the bottom (not shown), the pair of which are for the sole purpose of receiving a wrench used in threading same onto the mandrel preparatory to adding barrel section 8 to splined member 6.

When bumping down, the female splined element 6 and all the barrel sections 8, 10 and 12 connected thereto along with drill pipe section 16 and the bit (not shown) that lie between it and the jar remain stationary for all practical purposes while the rod string above the jar, mandrel 4 and the knocker tube all move together as a unit downwardly from the extended position shown in FIGS. 4–6 into the retracted one of FIGS. 1–3. The splined connection is extended preparatory to bumping down by raising the drill string at the well floor. The bumping blow is delivered in conventional fashion by dropping the drill string downhole.

In a tool of the type illustrated, the stroke when bumping down can conveniently be made a foot and a half or more while keeping the overall length of the tool quite short when compared with prior art hydraulic jars having a comparable bumping stroke. The impact blow is delivered, of course, when downwardly-facing shoulder 30 of mandrel 4 strikes the opposed upwardly-facing shoulder 32 of female splined member 6.

The bumping action described above is by no means unique in the instant tool nor is any novelty claimed therefor. The jarring action is, likewise, similar to most of the prior art jars, the differences between the instant tool and others lying in the unique manner in which a high percentage of the tension load on the rod string is held by a hydraulically-actuated friction brake thus reducing the proportion of the load carried by the piston to a level which is far less than that which would damage any seals subjected thereto. More specifically, a system pressure of say 1000 p.s.i. or even less is translated into a braking force capable of cooperating with the piston to effectively resist tension loads of 30,000 pounds and more. This, together with the feature of employing the readily available drilling mud as the lubricant in a system which automatically functions during each actuation to replace such lubricant with a cool fresh supply while discharging downhole any that has heated up makes the instant jar completely unique among such tools.

The novel hydraulically-actuated braking system can best be seen in FIGS. 3, 6, 8, 9 and 10 to which detailed reference will now be made. In doing so, however, it will, perhaps, be helpful to explain in general terms how the prior art jars function because then the advantages of the instant jar will become even more apparent.

Other prior art jars use a ported piston lifted across a constriction in an annular chamber defined between the splined parts as they move from retracted into extended position relative to one another and the eventual sudden release of hydraulic pressure in the chamber as the piston leaves the constriction to deliver the upwardly-directed impact blow. Obviously, the greater the tension load on the drill string, the greater the hydraulic pressure in the chamber that acts upon the piston and seals used to confine the fluid. It will be seen that most of these same elements are present in the instant tool; however, their function is different and vastly more effective in performing the tools primary task, namely, that of jarring loose a stuck bit or other drill string element. To start with, fluid pressure in the cavity containing the floating piston is limited by suitable pressure relief means to a level far below that at which any significant seal damage will occur. Secondly, the volume of fluid trapped above the floating piston which heats up during its excursion past the bore restriction is not reused but instead discharged downhole and replaced with fresh fluid immediately after cessation of the slow movement part of the stroke. By lowering and controlling the pressure, the heat build-up and attendant reduction in viscosity ceases to be a problem, especially when the heating effect is not cumulative, and repeated actuations before the surrounding formation can recover and settle in again around the struck tool become, for the first time, a reality.

Figure 10:
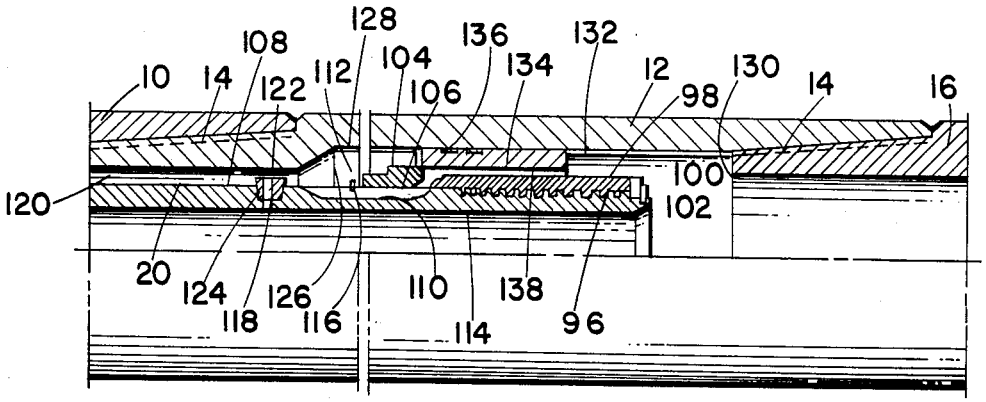

Referring to FIGS. 3, 6 and 10, it will be seen that the lower end 96 of knocker tube 20 is externally threaded as shown and an internally-threaded sleeve 98 screws onto the latter where it is retained by a conventional ring and snap ring subassembly 100, 102. Abutting the upper end of sleeve 98 as seen in FIGS. 3 and 6, is a floating piston 104 that rides atop a series of angularly-spaced ribs 106 formed on the outer cylindrical surface 108 of the knocker tube, the details of these ribs having been most clearly shown in FIG. 9. Separating these ribs from one another are longitudinally-extending channels 110 that are also best seen in FIG. 9. These channels enable drilling mud to move freely underneath and around piston 104 while the piston as shown in FIG. 10 has moved away from sleeve 98 and toward stop ring 112 as knocker tube 20 is returning to the position shown in FIG. 3 after having delivered a jarring blow and preparatory to delivering another one. As illustrated, an O-ring seal 114 is introduced between sleeve 98 and the outer cylindrical surface 108 of the knocker tube. Spaced above piston 114 when the latter occupies the position shown in FIGS. 3 and 6 is stop ring 112 which seats in an annular groove 116 formed in the ribs 106. A drain hole 118 connecting the bore 50 with the annular cavity 120 defined between barrel section 12 and the outside surface 108 of the knocker tube goes through the wall thereof. This hole in the preferred embodiment shown, is plugged by a ball check valve 122 having a spring 124 biasing same closed. This valve functions in the well-known manner to maintain the pressure in cavity 120 below a preselected maximum insuring that no seal damage occurs. This check valve can be replaced by a plug with an orifice through it of a preselected size or, alternatively, drain hole 116 can be done away with and a hole provided in the piston that permits fluid in chamber 120 to pass therethrough. All that is needed is some way of bleeding fluid out of chamber 120 above piston 104 at a controlled rate.

Barrel section 12 has a downwardly-facing shoulder 126 adjacent its upper end which defines an abutment for an upper sleeve insert 128. An upwardly-facing abutment 130 is, in the particular form shown, formed by the upper end of the section of drill pipe 16 threaded into the lower end of section 12. A second sleeve insert 132 rests atop the latter abutment while the adjacent ends of the two spacers hold tubular bore restrictor 134 in a preselected axial position between the ends of barrel section 12. The position of bore restrictor 134 can, of course, be varied by changing the lengths of the upper and lower sleeves confining the latter; however, a jarring stroke of about five inches has proven quite satisfactory. O-ring seals 136 are provided between the outside of bore restrictor 134 and the inside wall of the barrel section 12 for the purpose of producing an annular fluid-tight seal therebetween. The maximum outside dimension of floating piston 104 is selected to seal against the inside bore 138 of the flow restrictor as it moves up past the latter with the knocker tube 20 thus trapping a certain amount of drilling mud thereabove in annular chamber 120.

Figure 8:
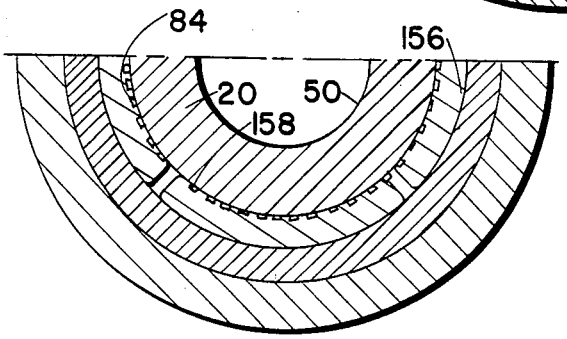
FIG. 8 is a diametrical half section taken along line 8—8 of FIG. 3.
Figure 9:
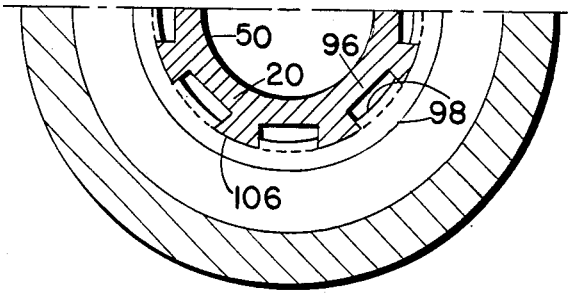
FIG. 9 is a diametrical half section taken along line 9—9 of FIG. 2; and, FIG. 10 is a fragmentary side elevation, again half in diametrical section, similar to FIGS. 3 and 6 but showing the parts moving from extended toward retracted relation.

The most significant feature of the instant jar is the fluid-actuated mechanical brake which is shown in FIGS. 3, 6 and 8 to which detailed reference will now be made. The upper end of barrel section 12 defines an annular upwardly-facing abutment for ring 140 that is most clearly shown in FIGS. 3 and 6. This ring has a series of openings 142 around its periphery that allows drilling mud to pass freely between cavity 120 and cavity 144 between the outer surface 84 of the knocker tube and the stepped annular surfaces 146 inside barrel section 10 that are of larger diameter than surface 90 at its upper end. Interior barrel surfaces 90 and 146 are separated from one another by a downwardly-facing annular shoulder 148 against which cam ring 150 rests.

Cam ring 150 has a downwardly and outwardly-flared frustoconical cam surface 152 that mates with complementary cam surfaces 154 on the upper end of ring segments 156 that encircle the cylindrical surface 84 of the knocker tube in spaced relation to one another as shown in FIG. 8. In the particular form shown, segments 156 are longitudinally grooved as indicated at 158 to prevent the hydrostatic pressure from locking these sleeve segments to the opposed surface 84 of the knocker tube when contracted thereagainst by elastic sleeve or boot 160. Fabricating the segmented sleeve 156 from aluminum has proven quite satisfactory, however, different materials, both metal and otherwise having a high coefficient of friction should perform just as well.

Elastic sleeve or boot 160 encircles the segmented ring and holds the segments thereof in frictional contact with the surface 84 of the knocker tube. The upper end of this sleeve abuts the underside of cam ring 162 and is shaped to provide a marginal flap 162 which cooperates with the main body thereof to produce a fluid seal much like seal 40 in FIGS. 1 and 3. When the drilling mud under pressure within annular cavity 144 impinges against this seal, flap 162 expands into fluid-tight annular sealed contact with the inner cylindrical surface 146 of barrel 10. The lower end of elastic boot 160 has an inturned flange 164 that covers the lower ends of the ring segments and lies in continuous annular contact with the outer surface 84 of the knocker tube. The upper end of barrel section 12 defines an annular abutment atop which ring 140 rests. Ring 140, in turn, supports the lower flanged end 164 of the boot and holds the latter up against the ring segments 156. The segmented friction ring is thus enveloped completely by elastic boot 160 and responds to a fluid pressure exerted against the latter by mud within cavity 144 to cause these segments to close down on the surface of the knocker tube thereby providing a friction brake effective to inhibit but not prevent relative movement of the knocker tube upwardly relative to the stationary barrel so long as drilling mud under pressure remains trapped in cavities 120 and 144. Without such hydraulic forces, the frictional contact of the ring segments, while present, is in no way sufficient to retard the upward movement of the knocker tube as it is pulled out of the hole by raising the rod string.

With specific reference to FIGS. 3 and 6, the sequence by means of which the tool 2 is actuated to jar up will now be described. At the outset, the various elements of the assembly will be fully retracted as seen in FIG. 3 except that piston 104 will not be resting atop sleeve 98 but instead be in a position more like that of FIG. 10 up against the underside of stop 116. To initiate a jarring blow, the rod string is raised up out of the bore at which point the mandrel 4 together with the knocker ring 20 begin to move up while the female member 6, the barrel sections, the bit and whatever else, if anything, suspended beneath the tool stays put. As the knocker tube begins to lift, clean mud filling cavity 120 will flow unimpeded down under and around floating piston 104 which, at this point, will still be at the lower end of restrictor 134 probably somewhere between stop 116 and sleeve 98 leaving the passages 110 therebeneath open. In the meantime, ball check 122 will be moving up through bore restrictor 134 into a position thereabove. Up until now, there will have been no increase in fluid pressure within either cavity 120 or 144. When, however, the upper end of sleeve 98 engages the underside of piston 104 and pushes it up to where the top thereof reaches the lower inside corner of the restrictor 134, the mud will be, for the first time, essentially trapped within cavity 144 and that portion of cavity 120 above the piston due to the fluid-tight seal that is provided by elastic boot 160. The piston is, of course, now resting atop sleeve 98 at this point in its travel and no mud can bypass it underneath by flowing through the channels 110 between the ribs. Note, however, that some mud is still escaping back into the bore through the passage 118 in the ball check valve 122. The degree to which the hydraulic pressure builds in adjoining cavities is, of course, determined by the opening pressure at which this check valve is set. If the check valve is replaced by a controlled diameter orifice or, alternatively, this pressure relief feature is moved from the knocker tube to the piston itself, the result is much the same, namely, the fluid pressure in cavities 120/144 is allowed to build up while the piston 104 moves slowly up across restrictor 134 until it suddenly releases. By using a check valve or analogous positive pressure relief element, the pressure in the aforementioned adjoining cavities can be limited to that which will not damage the seals. Fluid seals such as these can seldom be relied upon under pressures much in excess of 5000 p.s.i., yet, much higher pressure than this (4 or 5 times) are commonplace in the prior art jars. By using controllable hydraulic pressure and using fresh supplies of clean cool drilling mud as the working medium acting upon a mechanical brake, it becomes possible to keep the pressures acting against these seals at a level well below that at which they fail while, at the same time, applying these modest pressures to a mechanical braking system having an area many times that of the seals.

More specifically, if the pressure in cavities 120/144 is limited by the check valve 122 to only 500 p.s.i. which is a small fraction of that which will result in damage to the seals, it can be shown how such a modest pressure translates by means of the instant invention to an effective restraining force operative to impede the movement of the tool into extended position that is many times that of the prior art jars. If, for example, the internal diameter "A" of the restriction is 4.625 inches and the outer diameter of the knocker tube "B" is 3.50 inches, then the piston area subjected to the fluid pressure in cavity 120 is calculated as follows:

$$\text{Piston Area} = \pi \frac{(\text{"}A\text{"}^2 - \text{"}B\text{"}^2)}{4} = \pi \frac{(4.625^2 - 3.5^2)}{4} = 7.18 \text{ in}^2.$$

Next, assume the outside diameter "C" of the segmented aluminum ring 156 is 4.50 inches and its length "1" is 20 inches, then:

Surface of Al jaws
$= \pi \times \text{"C"} \times \text{"1"} = \pi \times 4.5 \times 20 = 282.74 \text{ in.}^2$ When piston 104 moves into the restrictor 134 and the fluid pressure in cavity 120 is 500 p.s.i., then the force carried by the exposed area of the piston will, of course, be:

$500 \times 7.18 = 3590$ lbs.

The friction force between the knocker tube 20 and the aluminum ring segments is:

friction = normal force × coefficient of friction "*f*"

"*f*" for Aluminum = 0.4 dynamic

= 0.6 static

However, for purposes of the present calculations, the "f" for aluminum has been assumed to be only 0.3.

normal force = area of ring segments × pressure = 282.74 × 500 = 141,379 lbs.

frictional force = 141,370 × 0.3 = 42,411 lbs.
total force = force carried by piston + force carried by ring = 3590 + 42,411 = 46,001 lbs.

In the prior art jars, the entire force is carried by the piston and a force of 3590 lbs. is insufficient to effectively retard extension of the tool, i.e., it is incapable of resisting a strong enough pull on the drill string to break the latter loose with a jarring blow once the piston leaves the restriction 134. The only answer, therefore, is to increase the fluid pressure with the resulting seal damage, and attendant problems already mentioned. On the other hand, the effective restraining force realized by the instant mechanically-assisted system is:

$$\frac{42{,}411}{3{,}590} = 11.81:1$$

as great as that which can be realized by the piston alone making it possible to use a modest fluid pressure with all the advantages this entails. Moreover, to increase the braking force without increasing the diameter of the tool or other equally significant dimensions, all one need to do is increase the length "1" of the aluminum jaws defined by segmented ring 156.

A tool such as the one just described can be made to provide an overall or total stroke in excess of 25 inches.

The bumping stroke will be in the neighborhood of 17 inches while the jarring stroke will be about 5 inches. The restricted travel of the piston will be somewhere around 4 inches in such a situation.

The tool as shown possesses certain features which, while of lesser significance, nonetheless, contributes to the overall braking forces inhibiting movement of the tool into fully-extended jar-producing relation. For instance, as the jaws defined by the segmented sleeve or ring are carried upward frictionally by the knocker tube, the tapered upper end 154 thereof rides underneath the flared surface 152 of the cam ring which acts to wedge the segments into tighter frictional contact with the tube. Similarly, the fluid pressure in cavity 120 pushing up against ring 140 presses against the downturned flange of the elastic boot and it, in turn, acts to wedge the ring segments underneath the flared surface of the cam ring.

Once the knocker tube has impacted the anvil 66 and delivered the jarring blow, the elements of the tool thus extended can be returned immediately to their retracted positions preparatory to delivering a repeat blow before the formation can recover and settle in again around the stuck part because the drilling mud in cavities 120 and 144, to whatever slight degree it was heated at an elevated pressure of only a few hundred p.s.i., is exhausted downhole past the piston and replaced with a fresh cool supply thereof. As the knocker tube returns to its fully-retracted position, piston 104 will be stopped by the restrictor 134 until it is picked up by stop 112, whereupon, it continues its downward excursion with the knocker tube where it is situated at the beginning of the next jarring cycle.

What is claimed is:

1. In a hydraulic jar tool of the type having inner and outer tubular elements telescopically interconnected for conjoint rotational movement and relative longitudinal movement between extended and retracted positions, opposed surfaces relatively movable upon extension of the tubular elements into jarring contact with one another, opposed overlapping surfaces of the telescoped elements cooperating with one another to define an annular chamber having means for introducing a hydraulic fluid therein, the inner tubular element being connectable to a hollow drill pipe string for carrying drilling mud thereto, the outer tubular element being connectable to an object to be jarred in a well, abutment-forming means within the chamber carried by one of the telescoped elements, seal means abutting the abutment-forming means cooperating therewith to seal off one end of the chamber, the same telescoped element carrying the abutment-forming means also carrying means for constricting the chamber located in longitudinally-spaced relation to the seal means, piston means carried by the other of the telescoped elements for movement therewith, the piston means and constriction means cooperating with one another and with the seal means upon movement of the telescoped elements toward extended position to seal and confine a body of fluid within the chamber, fluid metering means opening into the chamber operable when the piston means and constriction means are in sealed relation to retard movement of the telescoped elements into extended position, and fluid bypass means positioned and adapted to release the telescoped members for unrestrained extendable movement until the opposed surfaces engage one another to deliver an upward jarring blow to the object to be jarred as the piston means moves beyond the constriction means, the improvement which comprises: brake means movable into frictional contact with the overlapping surface of the one telescoped element that moves relative to the other telescoped element carrying the abutment-forming means, said abutment-forming means being positioned and adapted to oppose longitudinal movement of said brake means with the said one telescoped element for at least a substantial portion of its travel toward fully-extended position, and means comprising a fluid-impervious elastic boot arranged within said chamber in juxtaposition to the brake means while sealing off the latter from the fluid contained therein, said boot being responsive to an increase in fluid pressure within said chamber and operative when so actuated to flex and press said brake means into frictional engagement with said one telescoped element thereby supplementing and assisting in the retardant action occasioned by the piston means moving past the constriction means as the fluid is slowly bled from said chamber through the metering means.

2. The improvement as set forth in claim 1 wherein the inner telescoped element is provided with means for accepting drilling mud from said hollow drill string and delivering same to the chamber for use as hydraulic fluid to be exhausted through the metering means.

3. The improvement as set forth in claim 1 wherein the area of the brake means subjected to the effective braking forces exerted thereagainst by the elastic boot by the fluid in said chamber substantially exceed the area of the piston means exposed thereto.

4. The improvement as set forth in claim 1 wherein: the abutment-forming means is located above the brake means with respect to a transverse axis of the tool, said abutment-forming means and brake means having their adjacent ends shaped to define mutually engageable cam surfaces cooperating upon movement of the telescoped elements toward extended position to cam said brake means into tighter frictional contact with said one telescoped element supporting same as the latter is pulled upward.

5. The improvement as set forth in claim 1 wherein: the brake means comprises a longitudinally-segmented sleeve.

6. The improvement as set forth in claim 1 wherein: the brake means includes a surface in frictional engagement with said one telescoped element carrying same and wherein said surface is longitudinally grooved.

7. The improvement as set forth in claim 1 wherein: the fluid metering means comprises a check valve operative to limit the fluid pressure in the chamber to a level substantially less than that which would damage or cause premature failure of the seal means.

8. The improvement as set forth in claim 1 wherein: the effective area of the brake means exposed to the action of the elastic boot is at least ten times the area of the piston means opening into the chamber.

9. The improvement as set forth in claim 1 wherein: the telescoped elements in retracted position cooperate to define an opening at the lower end of the chamber communicating with the interior of the hollow drill string and effective to admit and fill said chamber with drilling mud under the influence of the head of the mud column thereabove.

10. The improvement as set forth in claim 1 wherein: the brake means is carried by the inner tubular element, the elastic boot surrounds said brake means and becomes operative upon actuation to collapse thereaginst.

11. The improvement as set forth in claim 1 wherein: the abutment-forming means is located in the upper end of the chamber, a second abutment-forming means is located within said chamber in fixed spaced relation beneath said first-mentioned abutment-forming means, and in which said first-mentioned and second abutment-forming means cooperate with one another to maintain the brake means and boot in a substantially fixed longitudinal position with respect to said other telescoped element as said one telescoped moves longitudinally relative thereto.

12. The improvement as set forth in claim 1 wherein: said one telescoped element comprises the inner telescoped element, said inner telescoped element has an outer surface, a pair of longitudinally-spaced stop-forming means are provided on said outer surface, and the piston means is mounted on said outer surface for longitudinal sliding movement between said stop-forming means.

13. The improvement as set forth in claim 1 wherein: said other telescoped element comprises the outer tubular element, the constriction means comprises a sleeve detachably secured in a selected longitudinal position intermediate the ends of the chamber.

14. The improvement as set forth in claim 2 wherein: the means for accepting drilling mud comprises an opening at the lower end of said chamber defined between the overlapping surfaces of said telescoped members, and wherein said fluid metering means comprises an orifice in said inner tubular element operative to exhaust drilling mud back into the hollow interior of the drill string at a predetermined rate.

* * * * *